US008672479B2

(12) United States Patent
Haddadi

(10) Patent No.: US 8,672,479 B2
(45) **Date of Patent: *Mar. 18, 2014**

(54) VISUAL DEVICE INCLUDING AN OPHTHALMIC LENS HAVING A PARTIALLY CROPPED INSERTION RIB, AND METHOD FOR PREPARING SUCH LENS

(75) Inventor: Ahmed Haddadi, Charenton le Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 904 days.

This patent is subject to a terminal disclaimer.

(21) Appl. No.: 12/864,569

(22) PCT Filed: Dec. 24, 2008

(86) PCT No.: PCT/FR2008/001824

§ 371 (c)(1),
(2), (4) Date: Jul. 26, 2010

(87) PCT Pub. No.: WO2009/103910

PCT Pub. Date: Aug. 27, 2009

(65) Prior Publication Data

US 2010/0309429 A1 Dec. 9, 2010

(30) Foreign Application Priority Data

Jan. 28, 2008 (FR) ..... 08 00451

(51) Int. Cl.
*G02C 3/00* (2006.01)
*G02C 7/00* (2006.01)
*G02C 7/02* (2006.01)

(52) U.S. Cl.
USPC ..... 351/159.67; 351/159.74

(58) Field of Classification Search
USPC ..... 351/159.67, 159.73, 159.74, 178
See application file for complete search history.

(56) References Cited

U.S. PATENT DOCUMENTS

| | | | | | |
|---|---|---|---|---|---|
| RE16,232 | E | * | 12/1925 | Stevens | 351/102 |
| 1,600,605 | A | * | 9/1926 | Stevens | 351/102 |
| 5,926,247 | A | * | 7/1999 | Kimura | 351/41 |
| 6,142,628 | A | * | 11/2000 | Saigo | 351/204 |
| 2001/0036794 | A1 | | 11/2001 | Hatano | |

FOREIGN PATENT DOCUMENTS

EP 61002 A1 * 9/1982

OTHER PUBLICATIONS

International Search Report dated Sep. 9, 2009, from corresponding PCT application.

* cited by examiner

*Primary Examiner* — James Greece
(74) *Attorney, Agent, or Firm* — Young & Thompson

(57) ABSTRACT

Visual equipment includes an ophthalmic lens having an edge face provided with an engagement ridge. Also described is a method of preparing such equipment. The engagement ridge includes at least fifteen bearing sections alternating with as many free singular sections, the free singular sections being smaller in width and/or in height by at least 0.05 millimeters relative to the bearing sections (Sa).

20 Claims, 6 Drawing Sheets

Fig.6
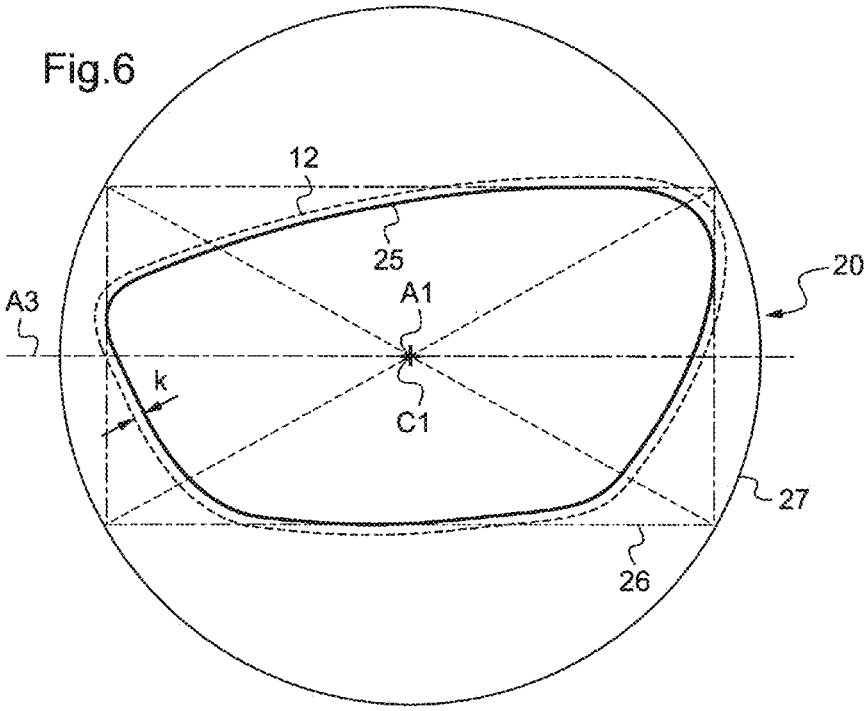
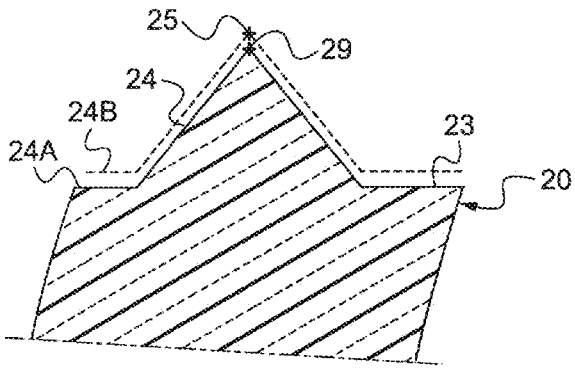
Fig.7A
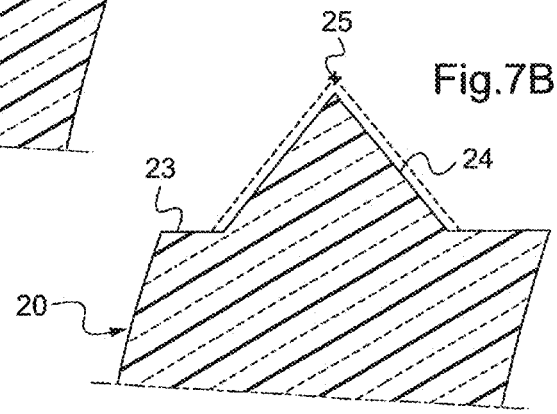
Fig.7B

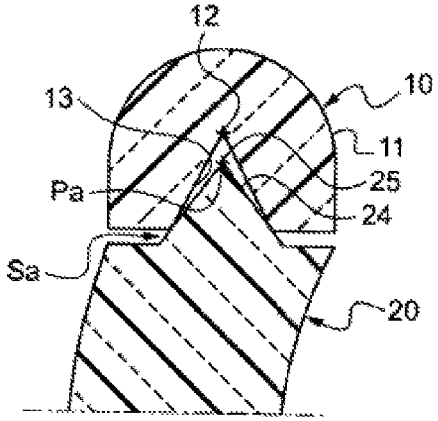
Fig.8A
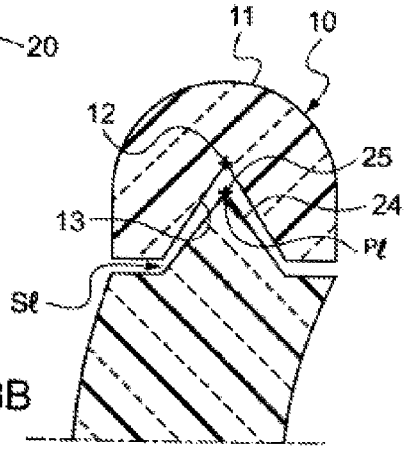
Fig.8B
Fig.9
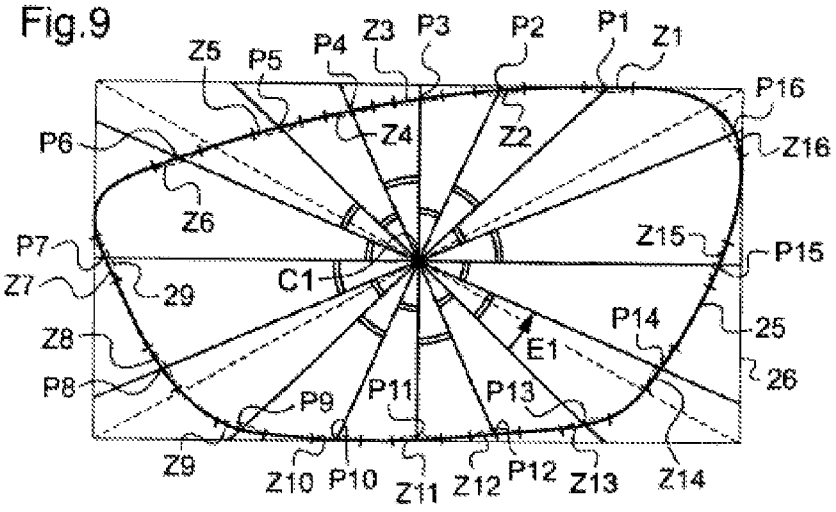

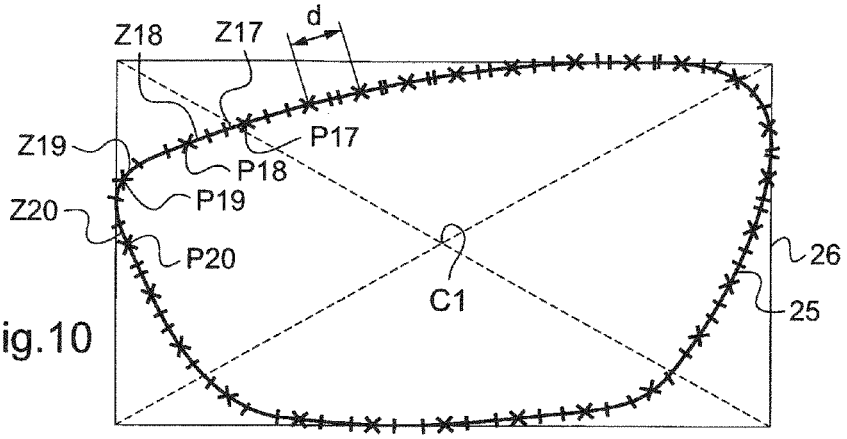
Fig.10
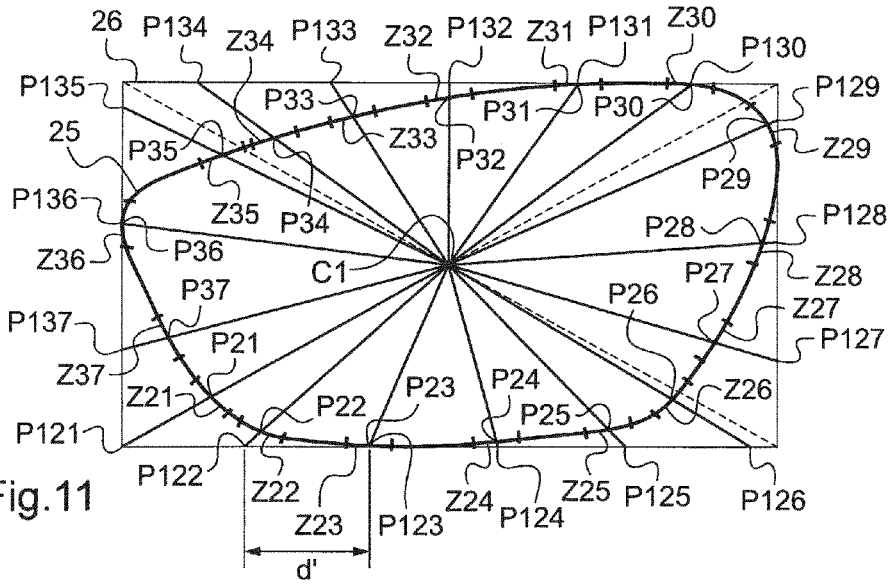
Fig.11
Fig.12
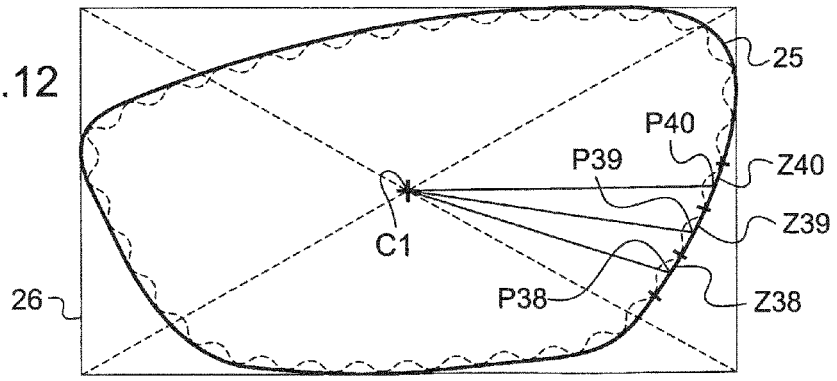

VISUAL DEVICE INCLUDING AN OPHTHALMIC LENS HAVING A PARTIALLY CROPPED INSERTION RIB, AND METHOD FOR PREPARING SUCH LENS

TECHNICAL FIELD TO WHICH THE INVENTION APPLIES

The present invention relates in general to the field of mechanical optics, and more precisely to preparing ophthalmic lenses for engagement in the surrounds of rimmed eyeglass frames.

More precisely, the invention relates to visual equipment including at least one ophthalmic lens and to a method of preparing such an ophthalmic lens.

TECHNOLOGICAL BACKGROUND

The technical portion of the profession of an optician consists in mounting a pair of correcting ophthalmic lenses on a rimmed eyeglass frame as selected by a wearer. Such mounting comprises three main operations:

- acquiring the shape of the internal outlines of the surrounds of the frame;
- centering each lens, which operation consists in positioning and orienting each lens appropriately in front of each eye of the wearer; and then
- machining each lens, which consists in cutting out or shaping its outline to the desired shape, taking account of the shapes of the surrounds and of the defined centering parameters.

In the context of the present invention, attention is given more particularly to the first and third operations referred to as acquisition and machining. The specific object of the optician is to edge the ophthalmic lens in such a manner as to enable it to be fitted mechanically and pleasingly to the shape of the corresponding surround of the selected frame, while also ensuring that the lens performs the optical function for which it is designed as well as possible.

With rimmed frames, the machining operation includes in particular a bevelling step that serves to form an engagement ridge, commonly called a bevel, on the edge face of the lens and suitable for engaging in a groove, commonly called a bezel, that runs along the inside face of the corresponding surround of the frame.

Both the acquisition and the machining operations need to be performed with particular care so as to ensure that the lens can be properly engaged in its surround, without force, and at the first attempt, i.e. without requiring a subsequent reworking.

In order to acquire the shape of the bezel, it is general practice to use an outline reader appliance that includes a feeler that picks up the shape of the bezel. Nevertheless, at the end of this feeling operation, errors are observed in the measurement of the shape of the outline. These errors are inherent to the reader appliance that may present resolution that is not sufficient, or assembly defects, or indeed that may be damaged or out of adjustment. In addition, while the bezel is being felt, any deformation of the frame (as a result of the feeler bearing against the bezel) likewise give rise to errors.

At the end of the machining operation, edging errors are also observed, such that the actual shape of the edge face of the lens does not correspond exactly to the desired shape. These errors are likewise inherent to the shaper appliance that may present resolution that is insufficient, or assembly defects, or that may include a grindwheel that is worn in shape. Furthermore, the bending deformations of the lens (due to the grindwheel bearing against the edge face of the lens while it is being machined) also give rise to errors, as do the phenomena of lenses expanding while they are being machined.

To sum up, and given the various errors and inaccuracies, a lens as machined in this way presents an outline that rarely corresponds exactly the outline of the bezel of its surround. It runs the risk of being either too big, thereby constraining the optician to perform additional and time-consuming machining of the engagement ridge, or too small.

In order to increase the yield of lenses that are correctly edged at the first attempt, it is known to correct the defects of acquisition and shaper appliances in such a manner as to increase their resolutions and so as to enable them to take a greater number of parameters into consideration. It is also known to calibrate the appliances frequently. Nevertheless, such methods are lengthy, complex, and expensive to implement. Furthermore, the parameters actually taken into consideration are not exhaustive. As a result, the yield of lenses that are correctly edged at the first attempt is still not satisfactory.

Furthermore, a large fraction of lenses that are considered as being mountable in their surrounds are in fact slightly too big relative to their surrounds, such that once they have been engaged therein, they are mechanically under stress. As a result, such lenses are weakened and their treatment layers are likely to be damaged more quickly. Furthermore, these mechanical stresses modify the optical characteristics of lenses to some extent and that can be troublesome for their wearers.

It is also known to acquire the shapes of the bezels of the surrounds of an eyeglass frame by means of a database registry containing a plurality of records, each associated with a particular model of eyeglass frames. Nevertheless, as a result of manufacturing dispersions, it is observed that no two eyeglass frames of a given model ever present exactly the same shape. Consequently, the shapes acquired from the database are generally slightly different from the real shapes of the bezels of the particular eyeglass frame as selected by the wearer. As a result, lenses machined as a function of such acquired shapes are not always mountable in the surrounds of the selected frame, such that it is often necessary to rework the machining of their engagement ridges.

It is also known to acquire the shape of the bezel of one of the surrounds of an eyeglass frame as a function of the shape previously acquired for the bezel of the other surround of the eyeglass frame, assuming both surrounds are symmetrical. Nevertheless, as a result of manufacturing dispersions, it is observed that the two surrounds of the same eyeglass frame are never completely symmetrical. Consequently, the shape of a bezel as derived by symmetry is generally slightly different from the real shape of the bezel of the second surround. As a result, a lens machined as a function of such a derived shape is not always mountable in the corresponding surround of the frame, such that it is often necessary to rework the machining of its engagement ridge.

OBJECT OF THE INVENTION

In order to remedy the above-mentioned drawbacks of the state of the art, the present invention proposes visual equipment including an ophthalmic lens shaped in such a manner as to increase the probability that it engages in its surround at the first attempt without being subjected to excessive mechanical stresses.

More particularly, the invention provides visual equipment comprising an ophthalmic lens including an edge face provided with an engagement ridge, wherein said engagement ridge includes at least fifteen bearing sections alternating with as many free singular sections, said free singular sections being smaller in width and/or in height by at least 0.05 millimeters relative to said bearing sections.

By means of the invention, the ophthalmic lens is edged in such a manner that its engagement ridge does not come into contact with the bezel over its entire periphery, but rather in such a manner as to cause spaces to appear between the engagement ridge of the lens and the bezel of the surround of the frame in said free singular sections.

Consequently, if the engagement ridge should, by error, be machined with an outline that is slightly too big relative to the outline of the bezel, these spaces enable the outline to deform locally so as to compensate for said machining error. In this way, the lens may be engaged in its surround without that giving rise to excessive mechanical stresses on the lens.

To summarize, the errors inherent in the operation of reader and shaper appliances are compensated, not by increasing the accuracy of those appliances, but rather by making allowance for the appliances to give rise to errors in the edging of the lens.

The number fifteen for the free singular sections ensures that at least one of these sections will always be located close to a zone in which the surround can deform (in particular close to highly curved zones of the surround). Selecting the positions for these free singular sections along the engagement ridge in random manner then enables the algorithm that implements the method of preparing the visual equipment to execute very fast.

In an embodiment of the invention, the engagement ridge is such that along any segment of said engagement ridge having a length of twenty millimeters along its curvilinear abscissa or contained within an angular sector of thirty degrees about a geometrically central or optical axis of the ophthalmic lens, its section varies in width or in height between a maximum width or height value and a minimum width or height value with the difference between them being greater than or equal to 0.05 millimeters.

In another embodiment of the invention, for visual equipment comprising firstly a frame provided with a surround including a bezel that is generally profiled and that extends along a first curvilinear longitudinal profile, and secondly an ophthalmic lens including an edge face provided with a profiled engagement ridge extending along a second curvilinear longitudinal profile and adapted to engage in said bezel, the second longitudinal profile is such that over any segment of said second longitudinal profile having a length of twenty millimeters along the curvilinear abscissa or contained within an angular sector of thirty degrees about a geometrically central or optical axis of the ophthalmic lens, the departure of the second longitudinal profile from the first longitudinal profile varies between a maximum departure value and a minimum departure value, with the difference between them being greater than or equal to 0.05 millimeters.

Advantageously, the difference between the maximum value and the minimum value is less than 0.3 millimeters.

It can be understood that in this embodiment of the invention, the ophthalmic lens is beveled on an outline that does not correspond uniformly to the outline of the bezel. The departure of the second longitudinal profile from the first gives rise physically to a small amount of space between the engagement ridge of the lens and the bezel of the surround of the frame. Consequently, if, by error, the engagement ridge is machined to have an outline that is too big compared with the outline of the bezel, this small space enables the surround to deform locally in order to compensate for the machining error. In this way, the lens can be engaged in its surround without the surround applying mechanical stresses that are too great on the lens.

The invention also provides a method of preparing an ophthalmic lens for mounting in a surround of an eyeglass frame, the method comprising:

an acquisition step of acquiring a first longitudinal profile of said surround; and an edging step of edging the ophthalmic lens with a generally profiled engagement ridge being formed on its edge face, the ridge having a desired section and extending along a second longitudinal profile derived from the first longitudinal profile. According to the invention, the method includes a determination step of determining at least fifteen free singular points along the second longitudinal profile in alternation with as many bearing points; and during the edging step, the engagement ridge is formed to present free singular sections at said free singular points and bearing sections at said bearing points, the free singular sections being smaller in width and/or in height than said bearing sections.

The invention also provides a method of preparing an ophthalmic lens for mounting in a surround of an eyeglass frame, the method comprising: an acquisition step of acquiring a first longitudinal profile of said surround; and an edging step of edging the ophthalmic lens with a generally profiled engagement ridge being formed on its edge face, the ridge having a desired section and extending along a second longitudinal profile derived from the first longitudinal profile. According to the invention, method includes a determination step of determining at least fifteen free singular points along the second longitudinal profile in alternation with as many bearing points; and during the edging step, the engagement ridge is formed so that the departure of the second longitudinal profile from the first longitudinal profile varies so as to take a value at each free singular point that is greater by at least 0.05 millimeters than the value of said departure at the two bearing points that are directly consecutive therewith.

DETAILED DESCRIPTION OF AN EMBODIMENT

The following description with reference to the accompanying drawings given by way of non-limiting example makes it clear what the invention consists in and how it can be reduced to practice.

In the accompanying drawings:

FIG. 6 is a face view of a non-edged ophthalmic lens, on which there can be seen a longitudinal profile of a bezel of a surround of an eyeglass frame, a longitudinal profile of an engagement ridge that the ophthalmic lens will present once it has been edged, and a boxing frame circumscribing the longitudinal profile of the engagement ridge;

FIGS. 7A and 7B are section views of the edge faces of two ophthalmic lenses edged using two different implementations;

FIGS. 8A and 8B are section views of an engagement ridge of an ophthalmic lens engaged in a bezel of an eyeglass frame respectively in a bearing section and in a free singular section; and FIGS. 9 to 15 are plan views of the longitudinal profile of the ophthalmic lens of FIG. 6 and its boxing frame.

Figure 1:
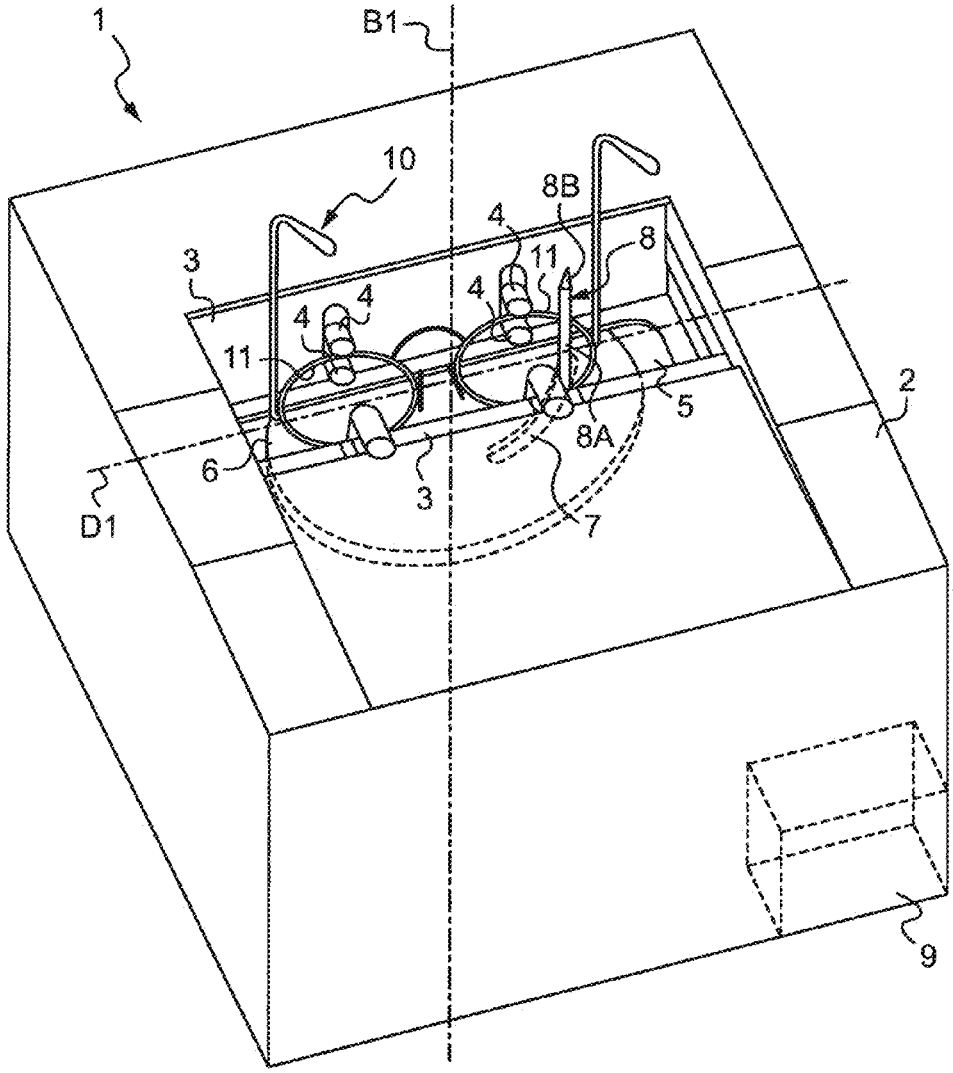
FIG. 1 is a perspective view of a reader appliance for reading the outline of bezels of eyeglass frames.

An object of the present invention is to facilitate engaging an ophthalmic lens in a surround of an eyeglass frame, and to improve the quality of that engagement.

The invention applies thus more particularly to rimmed eyeglass frames 10 (FIG. 1) having two surrounds 11 that are connected together by a bridge, and each of which is fitted with a temple. Conventionally, each surround 11 has a generally V-section groove running around its inside and commonly referred to as a bezel 11. The bezel extends along a curvilinear longitudinal profile 12. Such a bezel 13 is shown in section in FIG. 8A.

The longitudinal profile 12 corresponds to a contour of the bezel, extending over one and/or the other flank of the bezel and substantially parallel to or coinciding with the bottom edge of the bezel.

Relative to this longitudinal profile 12, it is possible to define a horizon line A3 (FIG. 6) that is substantially horizontal when the eyeglass frame 10 is worn by the wearer in the orthostatic position, i.e. when the wearer is upright and holding the head straight. The horizon line A3 in this example corresponds more particularly to the straight line passing in front of the two pupils of the wearer. It is characteristic of the orientation of the eyeglass frame 10 and of the ophthalmic lens 20.

Figure 2:
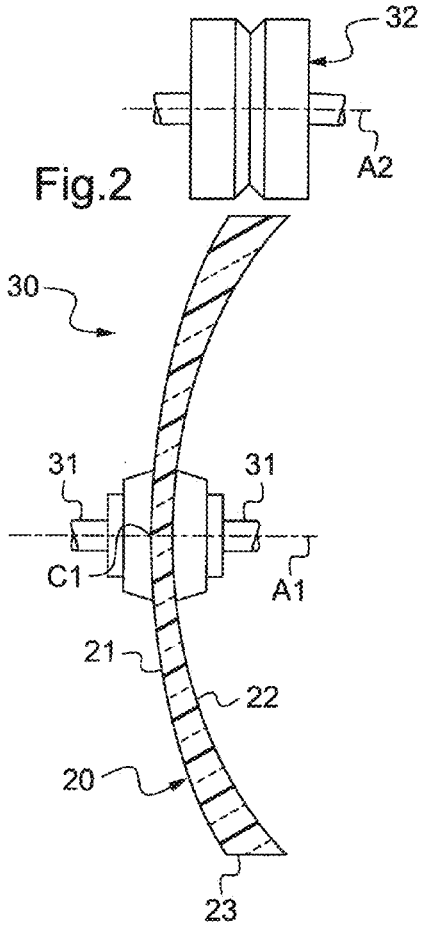
FIG. 2 is a diagrammatic view of an ophthalmic lens held in a shaper appliance provided with a beveling grindwheel.

As shown in FIG. 2, the ophthalmic lens 20 presents a front optical face 21 that is convex and a rear optical face 22 that is concave, together with a peripheral edge face 23 of initial outline 27 (FIG. 6) that is generally circular.

As shown in FIGS. 7A, 7B and 8A, 8B, the ophthalmic lens, after its edge face 23 has been machined, is to have an engagement ridge 24 that extends along a curvilinear longitudinal profile 25 (FIG. 2) of shape that enables the ophthalmic lens 20 to be engaged in the corresponding surround 11 of the eyeglass frame 10.

This longitudinal profile 25 corresponds to a line that runs along the edge face 23 of the lens and that meets a defined point of each cross-section of the engagement ridge 24. Each of these points in this example is defined by a rule that is uniform for all of the cross-sections of the engagement ridge 24. By way of example, the longitudinal profile 25 may correspond to one of the contours of the engagement ridge 24 that extends over one and/or the other of the flanks of said engagement ridge, and that is substantially parallel to or coincides with the top of the engagement ridge.

As shown in FIG. 6, a boxing frame 26 may be defined relative to the longitudinal profile 25.

The boxing frame 26 is defined more precisely as being the rectangle that firstly circumscribes the orthogonal projection of the derived longitudinal profile 25 in the plane of the initial outline 27, and secondly presents two parallel sides that are to extend horizontally when the lens is worn by the wearer.

At the intersection of its two diagonals, the boxing frame 26 presents a geometrical center C1 through which there passes an optical and geometrical central axis A1 of the lens (FIG. 2). The central axis A1 in question is substantially normal to the plane that is tangential to the front optical face 21 of the lens and that contains the point of the front optical face 21 that identifies the geometrical center C1 of the initial outline 27 when projected orthogonally onto the plane of the outline.

Device

In order to prepare such a lens, it is known to use an outline reader appliance 1, e.g. as shown in FIG. 1.

The appliance comprises a top cover 2 covering the entire appliance with the exception of a central top portion that is accessible to the user, and in which the eyeglass frame 10 is placed.

The outline reader appliance 1 serves to read the shapes of the outlines 11 of the bezels 13 of the surrounds of the eyeglass frame 10.

For this purpose it has a set of two jaws 3, one of which is movable, the jaws being provided with movable studs 4 that serve to clamp the eyeglass frame 10 between them in order to hold it stationary.

In the space left visible by the central top opening in the cover 2, there can be seen a structure 5. A plate (not visible) is movable in translation on the structure 5 along a transfer axis D. This plate has a turntable 6 mounted to turn thereon. The turntable 6 is thus suitable for occupying two positions along the transfer axis D1, each in register with a respective one of the two surrounds 11 of the eyeglass frame 10.

The turntable 6 possesses an axis of rotation B1 defined as being the axis normal to the front face of the turntable 6 and passing through its center. It is suitable for pivoting about said axis relative to the plate. The turntable 6 also includes an oblong slot 7 in the form of a circular are with a feeler 8 projecting therethrough. The feeler 8 comprises a support rod 8A of axis perpendicular to the plane of the front face of the turntable 6, and at its free end, a feeler finger 8B of axis perpendicular to the axis of the support rod 8A. The feeler finger 8B serves to slide, or possibly to roll, along the bottom of the bezel 13 in each of the two surrounds 11 of the eyeglass frame 10, by moving along the slot 7.

The outline reader appliance 1 includes actuator means (not shown) suitable, firstly to cause the support rod 8A to slide along the slot 7 so as to modify its radial position R relative to the axis of rotation B1 of the turntable 6, secondly to vary the angular position THETA of the turntable 6 about its axis of rotation B1, and thirdly to position the feeler finger 8B of the finger 8 at a greater or lesser altitude Z relative to the plane of the front face of the turntable 6. Each point felt by the end of the feeler finger 8B of the feeler 8 is thus identified in a corresponding system of cylindrical coordinates. The coordinates of each felt point of the bezel 13 are then written $ra_i$, $thetaa_i$, $za_i$.

The outline reader appliance 1 also includes an electronic and/or computer device 9 serving firstly to control the means for actuating the outline reader appliance 1, and secondly to acquire and record the coordinates $ra_i$, $thetaa_i$, $za_i$ of each felt point of the bezel 13.

In order to prepare the ophthalmic lens 20, it is also known to make use of a shaper appliance 30 that does not form part of the present invention, per se. Such a shaper appliance, is well known to the person skilled in the art, and is described for example in document U.S. Pat. No. 6,327,790, or sold by the Applicant under the trademark Kappa CTD.

As shown in FIG. 2, such a shaper appliance 30 generally includes support means, constituted in this example by shafts 31 for holding the ophthalmic lens 20 and for driving it in rotation about a blocking axis A1 coinciding with the central axis of the lens. Such a shaper appliance also includes shaper means, formed in this example by a machining tool 32 mounted to rotate about an axis of rotation A2 that is substantially parallel to the blocking axis A1, but that could equally well be inclined relative to said axis.

The machining tool 32 and/or the shafts 31 are provided with two freedoms of relative movements, including a radial freedom of movement enabling the spacing between the axis of rotation A2 and the blocking axis A1 to be modified, and a freedom of movement in axial translation along an axis parallel to the blocking axis A1.

The shaper appliance 30 also includes an electronic and/or computer device (not shown) that is provided firstly with communications means for communicating with the electronic and/or computer device 9 of the outline reader appliance 1, and secondly with the means for controlling the movements of the shafts 31 and of the machining tool 32. For each angular position of the lens about the blocking axis A1, this electronic and/or computer device serves in particular to control the radial spacing between the machining tool 32 and the blocking axis A1, and also the axial position of the edge face 23 of the lens relative to the working surface of the machining tool 32.

Figure 3:
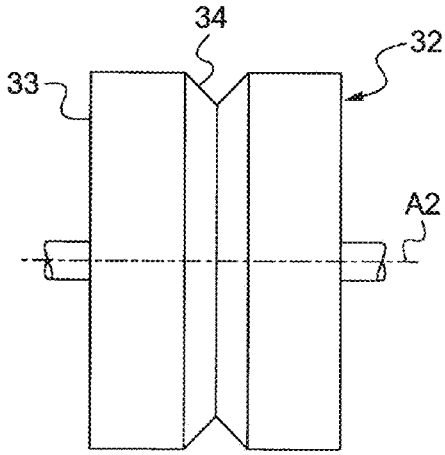
FIGS. 3 to 5 are side views of three beveling grindwheels.

As shown more particularly in FIG. 3, the machining tool 32 is, in this example, constituted by a main grindwheel 33 that is shaped, i.e. that presents a recessed machining profile of a shape that, like a negative, is complementary to the shape that is to be obtained in relief on the edge face 23 of the lens that is to be machined. This main grindwheel 33 constitutes a body of revolution about the axis of rotation A2 and it is provided with a beveling groove 34 suitable for forming an engagement ridge 24 (FIG. 8A) of complementary shape on the edge face 23 the lens 20. The diameter of the main grindwheel is preferably selected to be less than 25 millimeters.

This engagement ridge 24 is usually made to present, in cross-section, a profile in the form of an upside-down V-shape, which is why the engagement ridge 24 is commonly referred to as a bevel. Naturally, this engagement ridge could present some other shape in cross-section, e.g. a semicircular shape or a rectangular shape.

Figure 4:
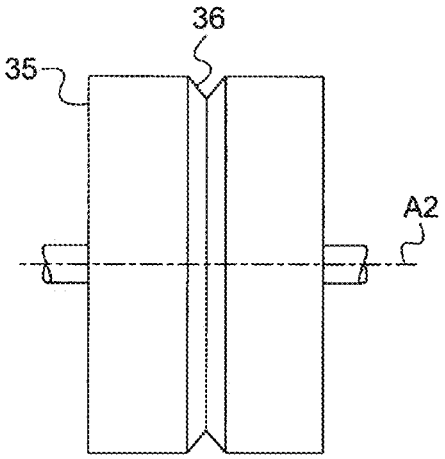

In a variant, and with reference to FIG. 4, provision may be made for the machining tool to include a set of grindwheels, including not only the above-mentioned main grindwheel 33, but also an auxiliary grindwheel 35 having a beveling groove 36 of depth and/or width that are less than that depth and/or width of the beveling groove 34 of the main grindwheel 33. This small beveling groove 36 may for example present a depth and a width that are 0.3 millimeters less than the depth and the width of the beveling groove 34 of the main grindwheel 33.

Figure 5:
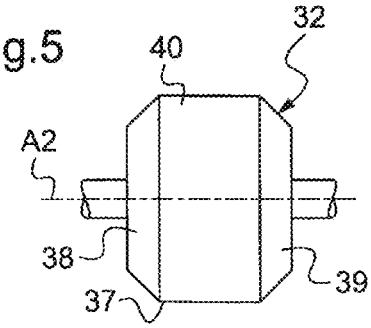

In another variant, as shown in FIG. 5, provision may be made for the machining tool 32 to include a wheel 37 presenting a central portion 40 that is circularly cylindrical about the axis of rotation A2, and on either side of its central portion 40, two end portions 38 and 39 that are circularly frustoconical about the axis of rotation A2 and that are disposed large base to large base. These two end portions 38 and 39 are then suitable for machining the two flanks of the engagement ridge 24 of the ophthalmic lens 20 in succession. Naturally, provision may also be made for these two end portions to be disposed facing each other and spaced apart from each other.

The machining tool may be of some other type. In particular, it could be formed by a milling or cutter tool mounted to rotate about the axis of rotation A2. The term "cutter tool" is used for a tool that presents, like a flat bit, a central shaft with two blades projecting radially therefrom on either side in a common plane and whose free edges are suitable for machining the edge face of the ophthalmic lens.

Method of Preparation

The method of preparing the ophthalmic lens is performed in four main steps. In particular, it comprises an acquisition step of acquiring the shape of the acquired longitudinal profile 12 of the bezel 13, a derivation step of deriving the shape of a derived longitudinal profile 25 for the engagement ridge 24, a determination step of determining free singular portions of the derived longitudinal profile 25, and an edging step of edging the ophthalmic lens 20.

During a first step of acquiring the shape of an acquired longitudinal profile 12 of the bezel 13, the eyeglass frame 10 selected by the future wearer is engaged in the reader appliance 1 (FIG. 1). To do this, the frame 10 is inserted between the studs 4 of the jaws 3 in such a manner that one of its surrounds 11 is ready to be felt along a path that starts by inserting the feeler 8 between the two studs 4 clamped to the bottom portion of said surround, after which it follows the outline of the bezel 13 of said surround 11.

More precisely, the electronic and/or computer device 9 defines as zero the angular position and the altitude of the feeler 8 when the feeler finger 8B is placed between the two above-mentioned studs 4.

Once the eyeglass frame 10 has been fastened and the feeler 8 is in contact with the bezel 13, the electronic and/or computer device 9 causes the turntable 6 to turn so that the feeler finger 8B of the feeler 8 moves continuously along the bottom of the bezel 13.

Contact between the feeler finger 8B and the bottom of the bezel 13 is conserved by actuator means applying a radial return force on the feeler 8 that is directed towards the bezel 13. This radial return force thus serves to prevent the feeler finger 8B from rising along one or the other of the flanks of the bezel 13, and serves to prevent it from escaping from the bezel.

Consequently, the feeler 8 is controlled in angular position about the axis of rotation B and it is guided depending on its radial coordinates and its altitude, in this example, by means of the V-shape of the bezel 13.

While the turntable 6 is turning, the electronic and/or computer device 9 then reads the three-dimensional coordinates $ra_i$, $thetaa_i$, $za_i$ of a plurality of points of the acquired longitudinal profile 12 of the bezel 13, e.g. 360 points, in order to store an accurate digital image of this profile. This image, in orthogonal projection onto the plane of the initial outline 27 of the ophthalmic lens 20, is drawn as a dashed line in FIG. 6.

In a variant, these three-dimensional coordinates could be acquired from a database registry. In this variant, the database registry includes a plurality of records, each associated with a referenced type of eyeglass frame (i.e. a shape of eyeglass frame). More precisely, each record includes an identifier that corresponds to the reference type of eyeglass frame, and a table of values e.g. specifying the three-dimensional coordinates of 360 points that are characteristic of the shapes of longitudinal profiles of the bezels of eyeglass frames of the referenced type. Thus, in order to acquire the three-dimensional coordinates $ra_i$, $thetaa_i$, $za_i$ of the acquired longitudinal profile 12, the operator may search in the database for the record of identifier that corresponds to the eyeglass frame selected by the wearer (e.g. by means of the bar code of the frame). Thereafter, the values referenced in the record are subsequently read and transmitted to the electronic and/or computer device of the shaper appliance 30.

A drawback that is generally observed when using this method of acquisition is that, since two frames of the same type rarely present exactly the same shape, the three-dimensional coordinates acquired from the database may be slightly different from the real coordinates of the corresponding points of the bezel. Nevertheless, by means of the invention and as set forth below, these small differences will not result in any problems for the ophthalmic lens 20 engaging in the surround 11 of the frame 10 selected by the wearer.

In another variant, the coordinates of the points of the acquired longitudinal profile may be acquired in a plane, e.g. on a photograph of the wearer. In this variant, firstly, a digital photograph is acquired of the wearer wearing the eyeglass frame. Then, secondly, the shape of the inner outline of each surround of the eyeglass frame is read from the acquired photograph, e.g. by means of image processing software. The coordinates $ra_i$, $thetaa_i$ of a plurality of points of the acquired longitudinal profile are thus determined.

During a second derivation step for deriving the shape of the derived longitudinal profile 25, the shape that should be presented by the top edge of the engagement ridge 24 is calculated so that said ridge may engage the previously felt bezel 13. This shape will thus make it possible to determine a setpoint for shaping the ophthalmic lens 20.

This derivation step may be performed by calculation means of the electronic and/or computer device hosted by the outline reader appliance 1 or by those of the shaper appliance 30, or indeed by those of any other device suitable for communicating with one and/or the other of these two appliances 1, 30.

During this second step, the calculation means respond to the three-dimensional coordinates $ra_i$, $thetaa_i$, $za_i$ of the points of the acquired longitudinal profile 12 to determine the shape of the derived longitudinal profile 25 (FIG. 6), i.e. the shape that should be presented by the top edge of the engagement ridge 24 once it has been shaped. This shape will enable the calculation means of the electronic and/or computer device of the shaper appliance 30 to derive radial and axial setpoints therefrom for shaping the ophthalmic lens 20.

In this example, the derived longitudinal profile 25 is defined by 360 points of three-dimensional coordinates written $rs_j$, $thetas_j$, $zs_j$.

The derived longitudinal profile 25 is derived from the acquired longitudinal profile 12 in the sense that it is defined either to coincide therewith, or else to be spaced apart therefrom by a spacing that is practically constant. More precisely, the coordinates $rs_j$, $thetas_j$, $zs_j$ of the 360 points of the derived longitudinal profile 25 are calculated from the coordinates $ra_i$, $thetaa_i$, $za_i$ of the 360 points of the acquired longitudinal profile 12 using the following mathematical relationship:

For i=j and for j from 1 to 360

$$rs_j=ra_i+k;$$

$$thetas_j=thetaa_i;$$

$$zs_j=za_i+f(thetas_i).$$

The constant k is calculated in conventional manner as a function of the architectures of the outline reader appliance 1 and of the shaper appliance 30, and as a function of the shapes of the cross-sections of the bezel in the surround of the frame and of the beveling groove of the main grindwheel 33. This constant k serves in particular to take account of the fact that once the lens is engaged in the surround, the top of the engagement ridge (corresponding to the derived longitudinal profile 25) never comes into contact with the bottom of the bezel (corresponding to the acquired longitudinal profile 12) but is slightly offset with respect thereto (FIGS. 8A and 8B).

The function $f(thetas_j)$ may be selected to be zero, or constant, or variable, in order to take account of a difference, if any, between the general cambers of the lens and of the bezel of the frame. This function is selected in particular so as to enable the axial position of the engagement ridge 24 on the edge face 23 of the ophthalmic lens 20 to be modified, e.g. in such a manner that the engagement ridge 24 extends along the front optical face of the lens, or else rather in the middle of its edge face.

During a third step, the calculation means proceed to detect at least fifteen free singular portions Z1-Z16 (FIG. 9) of the derived longitudinal profile 25.

More particularly, on the derived longitudinal profile 25, there are determined the positions of at least fifteen free singular portions Pl (FIG. 8B) that alternate with as many bearing points Pa (FIG. 8A) so as to make it possible subsequently to machine the lens in such a manner that the engagement ridge 24 is in contact with the bezel 13 at said bearing points Pa and out of contact with said engagement ridge 24 about said free singular points Pl (i.e. the free singular portions Z1-Z16). In this way, it is possible over the engagement ridge 24 to define at least fifteen bearing sections Sa that are situated at said bearing points Pa in alternation with as many free singular sections Sl situated at said free singular points Pl.

It can be understood that the bearing points are points where the engagement ridge 24 is machined in conventional and uniform manner so that the engagement ridge engaged in the bezel 13, and so that the free singular points are points where the engagement ridge 24 is machined in a non-uniform, or special manner such that the engagement ridge does not engage completely in the bezel 13.

Preferably, the bearing points Pa and the free singular points Pl are detected independently firstly of the shape of the first and second longitudinal profiles 12, 25, and secondly of the orientation of the horizon line of the frame of reference of the eyeglass frame 10, and thus of the orientation of the horizon line of the optical frame of reference of the ophthalmic lens 20.

Advantageously, said free singular points or sections are selected to be spaced apart by no more than twenty millimeters along the curvilinear abscissa of the engagement ridge 24 or by at most thirty degrees around the geometrical or optical axis of the ophthalmic lens 20, i.e. the central axis A1 in this example. In preferred manner, the number of free singular points or sections is then selected to lie in the range twenty to fifty.

The positions of the free singular points Pl may be determined in various ways.

For example, with reference to FIG. 9, the calculation means may select over the derived longitudinal profile 25 sixteen free singular points P1-P16 that are regularly spaced apart around the central axis A1, i.e. that present angular coordinates that are separated in pairs by a separation angle E1 that is equal to 22.5 degrees.

The starting free singular point P1 for this distribution (the point that determines the positions of the fifteen other free singular points P2-P16) may be selected randomly by the calculation means or it may be predetermined. By way of example, its angular position may be set at 135 degrees.

Thereafter, the calculation means define as free singular portions Z1-Z16 of the derived longitudinal profile 25, the sixteen portions of said profile that are centered on the sixteen free singular points P1-P16 and that present lengths F2 of less than 12 millimeters. These free singular portions present lengths F2 that may be identical, e.g. equal to 1 millimeter, or they may differ from one another.

The positions of the bearing points Pa are then derived from the positions of the sixteen free singular points P1-P16. More precisely, each bearing point Pa is defined as being a point of the derived longitudinal profile 25 that is situated at the center on the curvilinear abscissa between two free singular points.

In a variant, and with reference to FIG. 10, the calculation means may select a greater number N of free singular points P17-P20 that are regularly distributed along the derived longitudinal profile 25, i.e. that are spaced apart from one another by the same length d along the curvilinear abscissa.

In this example, the number N is selected to be equal to twenty-seven. Naturally, it could be selected to be equal to some other number N, greater than or equal to 15, preferably lying in the range 20 to 50. For reasons of clarity, only four of these free singular points are referenced in FIG. 10.

The starting free singular point P7 for this distribution may be selected randomly by the calculation means or it may be predetermined. Its angular position may for example be set at 240 degrees. Once positioned on the derived longitudinal profile 25, this free singular point P17 enables the calculation means to position the twenty-six other free singular points P18-P20 on the longitudinal profile.

The calculation means then define as free singular portions Z17-Z20 of the derived longitudinal profile 25, the twenty-seven portions of this profile that are centered on the twenty-seven free singular points P17-P20 and that present predetermined lengths, e.g. equal to 2 millimeters.

By means of this large number N of free singular points P17-P20, said free singular points are selected to be spaced apart by no more than twenty millimeters along the curvilinear abscissa of the engagement ridge 24 or by at most thirty degrees around the central axis A1.

In a variant shown in FIG. 12, the calculation means may select a very large number of free singular points P37-P40. For reasons of clarity, only three of these free singular points are referenced in this figure.

The calculation means may in particular select a number of free singular points P37-P40 such that, given their length, the corresponding free singular portions Z37-Z40 are all contiguous, such that each end of a free singular portion coincides with the corresponding end of another free singular portion.

To this end, the calculation means may distribute the free singular portions Z37-Z40 along the derived longitudinal profile 25 in such a manner that they are regularly spaced along the curvilinear abscissa of said profile or in such a manner that they are regularly spaced angularly around the central axis A1.

To do this, the calculation means may determine the total length of the derived longitudinal profile 25, and then divide this length by thirty so as to space the thirty free singular points regularly along this longitudinal profile. Each free singular portion is then defined as being centered on a free singular point and as presenting a length equal to one-thirtieth of the total length of the derived longitudinal profile 25. In a variant, the calculation means may space the thirty free singular points spaced apart regularly around the central axis A1 at an angular spacing of 12 degrees. Each free singular portion is then defined as being the portion of the derived longitudinal profile 25 that is centered on a free singular point, and having its ends angularly spaced apart from each other by 12 degrees.

Figure 13:
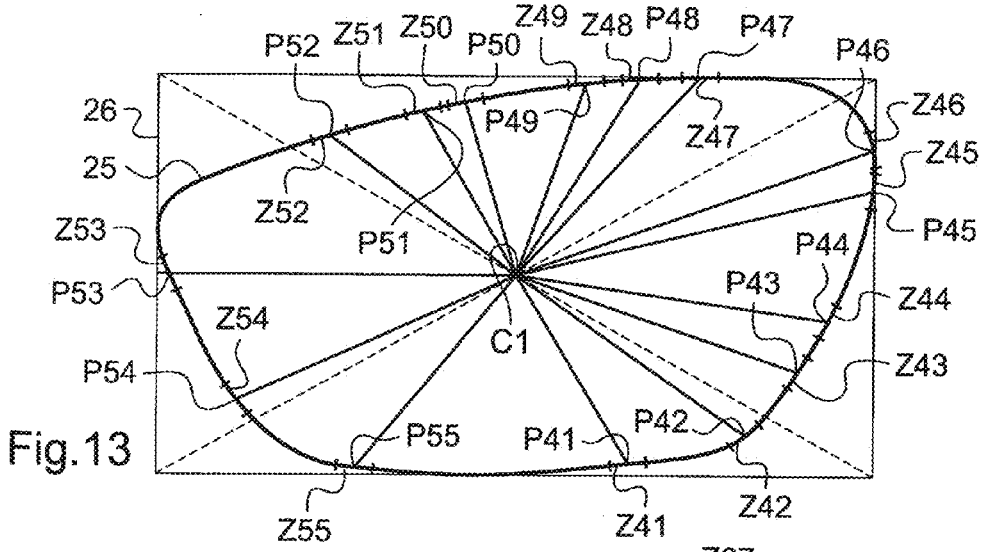

In a variant shown in FIG. 13, the calculation means may randomly select at least fifteen free singular points P41-P55 along the first derived longitudinal profile 25. More particularly, since the number N of free singular points is set, e.g. equal to 15, the calculation means may randomly select fifteen points among the 360 points of the derived longitudinal profile 25. Nevertheless, this selection may be performed with the reserve that these points should be spaced apart from one another by a separation angle that is greater than 5 degrees.

The calculation means then define as free singular portions Z41-Z55 of the derived longitudinal profile 25, those portions of the profile that are centered about these free singular points P41-P55 and that present predetermined lengths, e.g. equal to 12 millimeters.

In a variant, and with reference to FIG. 11, the calculation means may distribute the free singular points over the derived longitudinal profile 25 as a function of the shape of a third derived longitudinal profile 26 of shape that is a function of the shape of the derived longitudinal profile 25. More precisely, the calculation means may distribute at least fifteen free singular portions Z21-Z31 over the derived longitudinal profile 25 in such a manner that the corresponding portions of the third longitudinal profile 26 are regularly spaced apart around this central axis A1 or are regularly spaced apart along the third longitudinal profile 26.

To do this, the calculation means may select sixteen first free singular points P121-P137 that are regularly spaced apart along the boxing frame 26 (which forms the third longitudinal profile), at the same distance d'. Then, the calculation means establish a correspondence rule between the points of the boxing frame 26 and the points of the derived longitudinal profile 25. For this purpose, a point of the derived longitudinal profile 25 is defined as being associated with a point of the boxing frame 26 if both points have the same angular position around the blocking axis A1, i.e. if both points are situated on the same straight line passing through the geometrical center C1 of the boxing frame 26. These calculation means then derive therefrom the positions of sixteen second free singular points P21-P37 associated with the sixteen first free singular points P121-P137, and then they define as free singular portions Z21-Z37 of the derived longitudinal profile 25, the sixteen portions of said profile that are centered around said second free singular points P21-P37 and that present predetermined lengths, e.g. equal to 3 millimeters.

Figure 14:
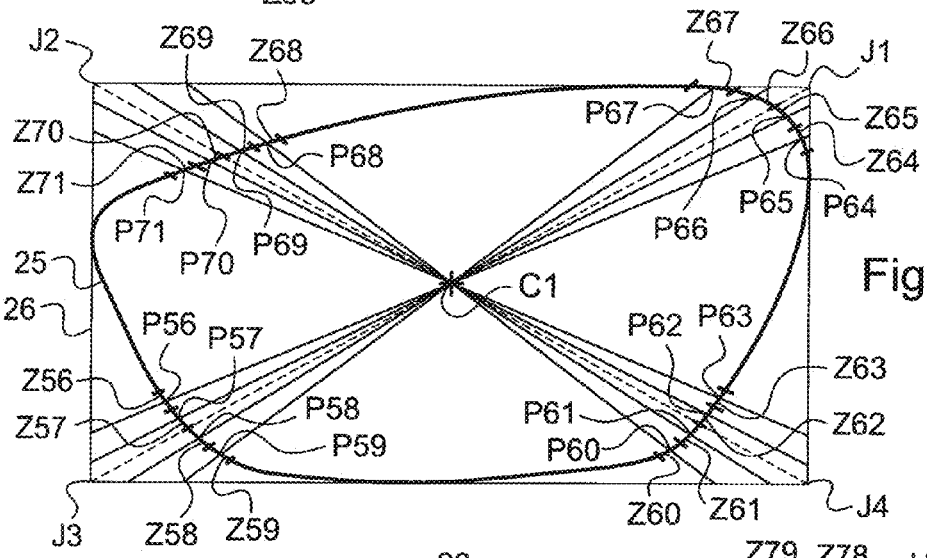

In another variant, and with reference to FIG. 14, the calculation means may determine the position of at least one remarkable point (presenting a radius of curvature less than a threshold) or of at least one angular point J1-J4 of a third longitudinal profile 26 (derived from the acquired longitudinal profile 12 or from the derived longitudinal profile 25), and may then distribute the free singular portions Z56-Z71 over the derived longitudinal profile 25 in such a manner that at least one corresponding portion of the third longitudinal profile 26 is situated at less than 5 millimeters from an angular point J1-J4 or from a remarkable point of third longitudinal profile 26.

In this example, a free singular portion Z56-Z71 is considered as being situated at less than 5 millimeters from an angular point or from a remarkable point of the third longitudinal profile 26 if at least one of its ends is situated at less than 5 millimeters from one of said points.

More particularly, the calculation means may select sixteen free singular points P56-P71, of which at least half are distributed at less than 5 millimeters from the intersections of the diagonals of the boxing frame 26 with the derived longitudinal profile 25.

For this purpose, they may select the sixteen points of the derived longitudinal profile 25 that are situated on the straight lines of the plane of the boxing frame that pass through the geometrical center C1 and that are inclined at 4 degrees or at 12 degrees relative to the diagonals of the boxing frame 26. These free singular points are generally situated in or close to highly curved portions of the derived longitudinal profile 25.

The calculation means then define as free singular portions Z56-Z71 of the derived longitudinal profile 25, the sixteen portions of said profile that are centered on these free singular points P56-P71 and that present predetermined lengths, e.g. equal to 0.5 millimeters.

Figure 15:
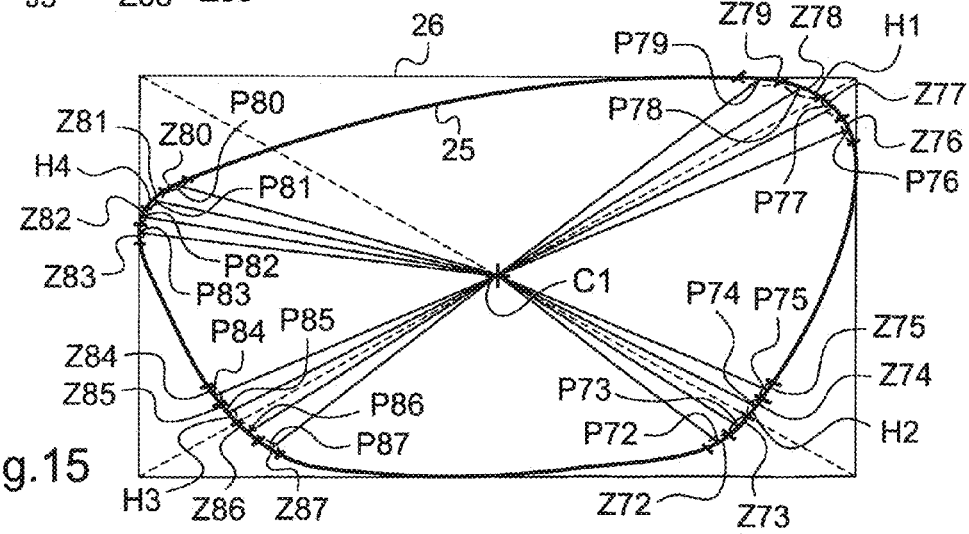

In a variant, and with reference to FIG. 15, the calculation means may distribute the free singular points P72-P87 over the derived longitudinal profile 25 in such a manner that at least one of these free singular points is situated at less than 5 millimeters from a highly curved portion of said derived longitudinal profile 25.

For this purpose, the calculation means determine the radii of curvature $Rc_j$ of the derived longitudinal profile 25 at each of its previously defined 360 points.

In this example, the radii of curvature are calculated in two dimensions, in the plane of the boxing frame 26. Naturally, in a variant, the calculation could also be performed in three dimensions.

The radius of curvature $Rc_j$ of the derived longitudinal profile 25 at each point $P_j$ is calculated as follows:

$$Rc_j=[(rs_j\cdot\cos(\text{thetas}_j)-a_0)^2+(rs_j\cdot\sin(\text{thetas}_j)-a_1)^2]^{1/2}$$

with:

$a_0=(b_0-b_1)/(b_2-b_3)$;

$a_1=b_1-b_2\cdot a_0$;

where:

$b_0=(c_0^2-c_1^2+c_2^2-c_3^2)/(2\cdot c_2-2\cdot c_3)$;

$b_1=(c_1^2-c_4^2+c_3^2-c_5^2)/(2\cdot c_3-2\cdot c_5)$;

$b_2=(c_1-c_4)/(c_3-c_5)$;

$b_3=(c_0-c_1)/(c_2-c_3)$;

and where:

$c_0=rs_{j+1}\cdot\cos(\text{thetas}_{j+1})$;

$c_1=rs_j\cdot\cos(\text{thetas}_j)$;

$c_2=rs_{j+1}\cdot\sin(\text{thetas}_{j+1})$;

$c_3=rs_j\cdot\sin(\text{thetas}_j)$;

$c_4=rs_{j-1}\cdot\cos(\text{thetas}_{j-1})$;

$c_5=rs_{j-1}\cdot\sin(\text{thetas}_{j-1})$.

In a variant, in order to determine each radius of curvature, the calculation means may derive a function $f(\text{thetas}_j)$ from the coordinates of the 360 points of the derived longitudinal profile 25, which function is representative of the derived longitudinal profile 25, in polar coordinates, and capable of being differentiated twice. Each radius of curvature is then calculated using the formula:

$$Rc_j=(f'^2+f^2)^{3/2}/(2\cdot f'^2+f^2-f\cdot f'')$$

where:

$f'=df(\text{thetas}_j)/d(\text{thetas}_j)$ and:

$f''=d^2f(\text{thetas}_j)/d(\text{thetas}_j)^2$

Thereafter, the calculation means compare the calculated values of the 360 radii of curvature $Rc_j$ with a threshold value.

Preferably, this threshold value is predetermined and stored in the calculation means. It is then preferably selected to be less than 20 millimeters, and in this example it is equal to 10 millimeters. In a variant, this threshold value may be determined as a function of the calculated values for the radii of curvature $Rc_j$. For this purpose, the threshold value may be selected as a function of the overall shape of the derived longitudinal profile 25. As non-limiting examples, the threshold value may be selected as a function of the mean, and/or of the standard deviation, and/or of the median of the 360 calculated radii of curvature $Rc_j$, or indeed as a function of the values of the smallest radii of curvature (typically as a function of the 10 to 60 smallest radii of curvature). In another variant, this threshold value may be selected so that only one radius of curvature is less than said value.

In any event, the comparison of the calculated radii of curvature $Rc_j$ with the threshold value of 10 millimeters makes it possible in this example to identify four remarkable points H1-H4 on the derived longitudinal profile 25, where the radii of curvature of the profile are less than said threshold value.

The calculation means may then select the sixteen free singular points P72-P87 of the derived longitudinal profile 25 that are situated on the half-lines in the plane of the boxing frame that start from the geometrical center C1 and that are inclined at 4 degrees or at 12 degrees relative to the four half-lines that start from the geometrical center C1 and that pass through the remarkable points H1-H4. Half of these sixteen free singular points are then situated at less than 5 millimeters from the remarkable points.

The calculation means then define as free singular portions Z72-Z87 of the derived longitudinal profile 25, the sixteen portions of said profile that are centered about the free singular points P72-P87 and that present predetermined lengths, e.g. equal to 1 millimeter.

In a variant of the invention that is not shown, the free singular portions may be determined manually by the operator.

For this purpose, a man/machine interface including at least a touch-sensitive screen and a stylus is made available to the operator. The interface is fitted with an electronic device suitable firstly for communicating with the electronic and/or computer device of the outline reader appliance or with the calculation means of the shaper appliance 30, and secondly of displaying images on the screen.

The electronic device is adapted in particular to display an image of the derived longitudinal profile 25 on the screen. In order to determine the position of each free singular portion of the derived longitudinal profile 25, the operator may thus use the stylus to point on the screen to at least fifteen free singular portions that the device stores and communicates to the calculation means.

Finally, during a fourth and last step, the shaper appliance 30 proceeds to edge the ophthalmic lens 20. This step is described below with reference to the variant shown in FIG. 9.

In a first embodiment of the invention, the lens support shafts 31 and/or the shaper tool 32 are controlled in compliance with an edging setpoint radius that differs from the initially provided edging setpoint radius (relative to the derived longitudinal profile 25) in the sixteen free singular portions Z1-Z16.

For this purpose, the calculation means correct the shape of the derived longitudinal profile 25 in the sixteen free singular portions Z1-Z16.

To obtain the coordinates of the 360 characteristic points of the new derived longitudinal profile 29, the calculation means reduce the values of the radial coordinates $rs_j$ of the initial derived longitudinal profile 25 that are situated in the free singular portions Z1-Z16. This reduction is implemented in such a manner that the new derived longitudinal profile 29 is continuous, presenting no angular point nor any cusp and within each free singular portion Z1-Z16 it departs by more than 0.05 millimeters and by less than 0.3 millimeters from the initial derived longitudinal profile 25. In this example, the reduction is performed in such a manner that the maximum departure of the new derived longitudinal profile 29 from the initial derived longitudinal profile 25 is equal to 0.1 millimeters.

The term "angular point" is used to designate a point of a profile where two half-tangents at that point form a non-flat angle. The term "cusp" is used to designate a point of a profile having two half-tangents that are opposite.

Finally, the lens is edged in conventional manner using the main grindwheel 33 of the shaper appliance 30 so that the top of the engagement ridge 24 (FIG. 7A) extends along the new derived longitudinal profile 29. The engagement ridge 24 is then profiled, i.e. it presents a section that is uniform over its entire length.

To summarize, on giving consideration to the visual equipment comprising the eyeglass frame 10 and the ophthalmic lens 20 engaged in the corresponding surround 11 of said frame, it can be seen that the new derived longitudinal profile 29 has sixteen free singular portions Z1-Z16, in each of which the departure of the derived longitudinal profile from the acquired longitudinal profile 12 is not uniform. More particularly, the departure of the new derived longitudinal profile 29 from the acquired longitudinal profile 12 varies so that, at each free singular point Pl, it takes on a value that is at least 0.05 millimeters greater than the value of said departure at the two bearing points Pa that are directly consecutive therewith.

As a result, the new derived longitudinal profile 29 is such that over the entire segment of said longitudinal profile 29 having a length of 20 millimeters along the curvilinear abscissa or contained within an angular sector of 30 degrees around the central axis A1, the departure of the new derived longitudinal profile 29 from the acquired longitudinal profile 12 varies between a maximum departure value and a minimum departure value, with the difference between them being greater than or equal to 0.05 millimeters and less than or equal to 0.3 millimeters (this difference being equal to 0.1 millimeters in this example).

Consequently, the new derived longitudinal profile 29 has sixteen bearing points Pa (FIG. 8A) alternating with as many free singular points Pl (FIG. 8B), with each bearing point Pa departing from the acquired longitudinal profile 12 by a common value k, which value is common to all the sixteen bearing points Pa to within 0.02 millimeters (as a result of inaccuracies in edging), and with each free singular point Pl departing from the first longitudinal profile by a value that differs from said common value k by free clearance of 0.1 millimeters.

Thus, by means of the invention, the engagement ridge 24 of the lens possesses firstly sixteen bearing sections Sa situated at the sixteen bearing points Pa where it comes into contact with the bezel 13, and secondly sixteen free singular sections Sl alternating therebetween and situated at the sixteen free singular points P1-P16 where they are out of contact with the bezel.

As a result, when the feeling of the bezel and/or when the shaping of the lens are performed imperfectly, and when, as a result, the outline of the lens is slightly too big relative to the outline of the surround 11, the space situated in the free singular sections St allows the surround to deform, such that the lens remains mountable in the surround.

Advantageously, provision may be made to store the shape of the new derived longitudinal profile 29 in a record of the database registry, together with the positions of the free singular points P1-P16 along said profile. In this way, when edging an ophthalmic lens for mounting in a frame of the same model, the calculation means can acquire from the database the shape of the new derived longitudinal profile 29 so as to machine the lens directly with this profile.

More precisely, after determining the three-dimensional coordinates of the points of the new derived longitudinal profile 29 and the positions of the free singular portions and/or of the free singular points, the electronic and/or computer device of the shaper appliance can transmit this data to the registry so that it stores it in a record with an identifier that corresponds to the eyeglass frame selected by the wearer.

In a second embodiment of the invention, the lens support shaft 31 and/or the shaper tool 32 are controlled in such a manner that the section of the engagement ridge 24 is locally reduced in width and/or in height (FIG. 7B) in the sixteen free singular portions Z1-Z16.

More precisely, the lens support shafts 31 and/or the shaper tool 32 are controlled to follow the first derived longitudinal profile 25 in such a manner as to make an engagement ridge 24 on the edge face 23 of the lens 20, which engagement ridge 24 is profiled, i.e. is of uniform section, except in the free singular portions Z1-Z16.

This embodiment presents a particular advantage. The fact of reducing only the size of the section of the engagement ridge 24 without changing the edging setpoint radius makes it possible to ensure that the distance between the flat beside the engagement ridge 24 (the portion of the edge face 23 of the lens adjacent to the engagement ridge 24) and the inside face of the surround 11 of the eyeglass frame 10 is uniform all around the lens. As a result, no unsightly gap appears between the edge face of the lens and the inside face of the surround 11.

Preferably, the edging of the ophthalmic lens 20 includes a first stage of machining the engagement ridge 24 to have a section that is uniform, and a second stage of paring away the engagement ridge 24 in each free singular portion Z1-Z16.

In this example, the first machining stage is performed using a shaped main grindwheel 33 (shown in FIG. 3) following the derived longitudinal profile 25, while the second stage is performed using the auxiliary grindwheel 35 (shown in FIG. 4).

During this second stage, the beveling groove 36 of the auxiliary beveling grindwheel 35 is brought into contact with the engagement ridge 24 at one of the ends of the free singular portion under consideration. Then the lens support shafts 31 and/or the shaper tool 32 are controlled so that the beveling groove 36 can machine and reduce the height and the width of the engagement ridge 24 in this free singular portion. As shown in FIG. 7B, this is done in such a manner that the height and the width of the engagement ridge 24 are reduced by no more than 0.3 millimeters and that the engagement ridge 24 does not present any discontinuity, in particular at the ends of each free singular portion Z1-Z16.

To summarize, when considering the visual equipment constituted by the shaped ophthalmic lens 20, it can be seen that its engagement ridge 24 presents a section that is reduced in width and/or in height in the sixteen free singular portions Z1-Z16. It can also be seen that the reduction in width and/or height of the engagement ridge 24 lies in the range 0.05 millimeters to 0.3 millimeters. Sixteen bearing sections Sa can thus be seen along the engagement ridge 24 alternating with as many free singular sections St, said free singular sections Sl being of width and/or height that is reduced relative to said bearing sections Sa. The space created between the engagement ridge 24 of the lens and the bezel 13 of the frame in each free singular section then makes it possible to facilitate engagement of the ophthalmic lens 20 in its surround 11.

As a result, the engagement ridge 24 is such that over the entire segment of said engagement ridge having a length of twenty millimeters along the curvilinear abscissa or contained in an angular sector of thirty degrees about the central axis A1, its section varies in width or in height between a maximum width or height value and a minimum width or height value, with the difference between them being greater than or equal to 0.05 millimeters.

It can also be seen that if the section of the engagement ridge 24 is reduced in height, then the derived longitudinal profile 25 along which said engagement ridge 24 extends is slightly deformed in said free singular portions Z1-Z16.

This way of shaping the ophthalmic lens 20 is not limiting. In particular, the engagement ridge 24 could be pared away in some other manner.

For example, this may be done during a second pass of the main grindwheel 33, with it being offset in a direction that is substantially parallel to the blocking axis A1, which offset transversely relative to the derived longitudinal profile 25. More precisely, during this second pass, the lens support shafts 31 and/or the shaper tool 32 may be controlled in each free singular portion Z1-Z16 in such a manner as to be offset progressively axially (along the blocking axis A1) from the positions they occupied during the first pass of the main grindwheel 33. Thus, during the second pass, one of the flanks of the engagement ridge 24 is machined by one of the flanks of the beveling groove 34 of the main grindwheel 33, thereby having the effect of reducing both the height and the width of said engagement ridge 24.

In another example, the engagement ridge 24 may be pared away using a singular portion of the main grindwheel 33, by planing down the top of the engagement ridge 24 so as to flatten its top edge, or even locally to eliminate the engagement ridge 24. In this variant, only the height of the engagement ridge 24 is modified.

In another variant of shaping the ophthalmic lens 20, it is possible to shape the flanks and pare away the engagement ridge 24 simultaneously.

More specifically, while beveling the lens using the main grindwheel 33, the lens support shafts 31 and/or the shape tool 32 may be controlled in such a manner as to present axial reciprocating movements (along the blocking axis A1). Thus, these reciprocating movements enable both flanks of the engagement ridge 24 to be planed away. In a variant, it is also possible to use the wheel shown in FIG. 5 for the purpose of machining the engagement ridge 24 in two successive stages, a machining stage for machining a first one of its flanks and a machining stage for machining a second one of its flanks.

For this purpose, initially, the electronic and/or computer device of the shaper appliance 30 controls the radial movement of the wheel and/or of the shafts 31 so as to position a first conical end portion 39 of the wheel 37 against the flank 23 of the lens, beside its front face. Thereafter, the wheel 37 and the lens support shafts 31 are controlled so as to form the front flank of the engagement ridge 24. Machining is performed so that the front face of the engagement ridge 24 is situated at a constant distance from the front optical face of the lens 20, except in the free singular portions, where it is spaced apart from said face.

Thereafter, the electronic and/or computer device of the shaper appliance 30 controls the radial movement of the wheel and/or of the shafts 31 to position a second conical end portion 38 of the wheel 37 against the edge face of the lens, beside its rear face. The wheel 37 and the lens support shafts 31 are then controlled to form the rear flank of the engagement ridge 24. In this example, this is done in such a manner that the rear flank of the engagement ridge is situated at a constant distance from the front face of the lens, except in the free singular portions where it comes closer to the front face. The engagement ridge of the ophthalmic lens thus presents local reduction in height and/or width in each free singular portion.

In another variant, the electronic and/or computer device of the shaper appliance 30 may control the radial movement of the machining tool and/or of the shafts 31 in such a manner as not only to reduce the width and/or the height of the section of the engagement ridge 24 in each free singular portion, but also to machine the flats beside the engagement ridge 24 (determining the shape of the new longitudinal profile from the shape of the derived longitudinal profile, in a method of the same type as that described above).

Advantageously, provision may be made to store the shape of the derived longitudinal profile 25 in a record of the database registry together with the positions of the free singular points P1-P16 along the profile. In this way, when edging an ophthalmic lens for mounting in a frame of the same model, the calculation means can acquire from the database the shape of said derived longitudinal profile 25, so as to machine the lens directly with this profile and so as to pare it away at the free singular points P1-P16.

After the ophthalmic lens has been edged, it is possible to edge a second ophthalmic lens for the purpose of mounting it in a second surround of said eyeglass frame 10, by forming a generally profiled engagement ridge on its edge face. This ridge is then made in such a manner as to follow a longitudinal profile that is symmetrical to the derived longitudinal profile 25 and in such a manner that each of its sections presents a shape that is identical to that of the (symmetrically) corresponding section of the engagement ridge 24 of the first lens.

By means of the invention, if the two surrounds of the eyeglass frame 10 are not accurately symmetrical even though both lenses have been machined symmetrically, the spaces that are situated between the engagement ridges of the lenses and the bezels of the surrounds in the free singular sections Sl enable both lenses to be mountable in their surrounds.

The present invention is not limited in any way to the embodiments described and shown, and the person skilled in the art knows how to make variations thereto in accordance with its spirit.

The invention finds a particularly advantageous application in methods of preparing lenses that are implemented by the clients (opticians) of contractors, i.e. clients who subcontract the fabrication and edging of lenses.

More precisely, consideration is given firstly to a client terminal installed on the premises of a client for ordering lenses and secondly to a manufacturer terminal installed on the premises of a lens manufacturer for fabricating and edging lenses.

The client terminal includes computer means for recording and transmitting order data for the ophthalmic lens 20, e.g. via an Internet protocol (IP) type communications protocol. The order data includes eyesight correcting prescription data (e.g. data concerning optical power, centering, . . . ) and data relating to the frame.

The manufacturer terminal has computer means for receiving and recording the order data transmitted by the client terminal. It also includes a device for fabricating an ophthalmic lens to comply with the prescription data, e.g. provided with means for molding the lens and/or for machining at least one of the optical faces thereof. It also includes a device for shaping the ophthalmic lens in compliance with the data relating to the frame. The shaper device is designed in particular to implement the above-described blocking and edging steps, in one or other of the various implementations described.

The method of preparing lenses is likewise performed in four steps in this example.

During the first step, the client determines a reference for the eyeglass frame 10 and then uses the client terminal to send order data for a lens (the order data including said reference).

The second step is performed by means of a database registry available to the manufacturer terminal, in which each record is associated with a type of eyeglass frame 10 and contains firstly a reference for the frame type, and secondly the shape of an acquired longitudinal profile 12 that is common to the surrounds 11 of frames of this type. During this second step, the manufacturer uses the reference acquired in the first step to search in the database registry for the shape of the acquired longitudinal profile 12 of the eyeglass frame selected by the wearer. Thereafter, the shape of the derived longitudinal profile 25 is derived from the acquired longitudinal profile 12 using the method described above.

Finally, during third and fourth steps, the manufacturer determines at least fifteen free singular portions on the derived longitudinal profile 25 and then shapes the lens in the special manner in these fifteen free singular portions.

As above, the lens is easily mountable at the first attempt in the frame selected by the wearer. As a result, there should be no need for the lens to be returned to the manufacturer in order to be reworked, where any such return is always lengthy and expensive.

In a variant, provision may be made for the step of acquiring the acquired longitudinal profile 12 as performed by the manufacturer terminal to comprise two steps, a first step of the client determining the shape of the acquired longitudinal profile 12, e.g. by feeling the surround of the eyeglass frame, and a second step of sending and receiving control data that includes the shape of the acquired longitudinal profile 12. In this variant, the positions of the singular portions along the acquired longitudinal profile 12 may be determined equally well by the manufacturer or by the client.

The invention claimed is:

1. Visual equipment comprising an ophthalmic lens (20) including an edge face (23) provided with an engagement ridge (24), wherein said engagement ridge (24) includes at least fifteen bearing sections (Sa) alternating with as many free singular sections (Sl), said free singular sections (Sl) being smaller in width or in height by at least 0.05 millimeters relative to said bearing sections (Sa).

2. Visual equipment according to claim 1, wherein said free singular sections (Sl) are spaced apart by no more than twenty millimeters along the curvilinear abscissa of the engagement ridge (24) or by no more than thirty degrees about a geometrically central or optical axis (A1) of the ophthalmic lens (20).

3. Visual equipment according to claim 1, wherein the number of free singular sections (Sl) lies in the range twenty to fifty.

4. Visual equipment according to claim 1, wherein the reduction in width or height of the engagement ridge (24) in each free singular section (Sl) is less than or equal to 0.3 millimeters.

5. Visual equipment according to claim 1, wherein said free singular sections (Sl) are regularly spaced apart along the curvilinear abscissa of the engagement ridge (24) or angularly around a geometrically central or optical axis (A1) of the ophthalmic lens (20).

6. Visual equipment according to claim 1, wherein the engagement ridge (24) extends along a second curvilinear longitudinal profile (25) from which it is possible to derive a third longitudinal profile (26) distinct from the second longitudinal profile (25) and in which each point is associated with a respective point of said second longitudinal profile (25), and said free singular sections (Sl) are distributed at points of the second longitudinal profile (25) for which the associated points of the third longitudinal profile (26) are regularly spaced apart along the curvilinear abscissa of said third longitudinal profile (26).

7. Visual equipment according to claim 1, wherein the engagement ridge (24) extends along a second curvilinear longitudinal profile (25) that presents at least one remarkable point (H1-H4) at which the radius of curvature of the second longitudinal profile (25) is at a minimum or less than a threshold, and at least one of said free singular sections (Sl) is situated at less than 5 millimeters from said remarkable point (H1-H4) along the curvilinear abscissa of the second longitudinal profile (25).

8. Visual equipment comprising an ophthalmic lens (20) including an edge face (23) provided with an engagement ridge (24), wherein said engagement ridge (24) is such that along any segment of said engagement ridge having a length of twenty millimeters along its curvilinear abscissa or contained within an angular sector of thirty degrees about a geometrically central or optical axis (A1) of the ophthalmic lens (20), its section varies in width or in height between a maximum width or height value and a minimum width or height value with the difference between them being greater than or equal to 0.05 millimeters.

9. Visual equipment comprising:

a frame (10) provided with a surround (11) including a bezel (13) that is generally profiled and that extends along a first curvilinear longitudinal profile (12); and an ophthalmic lens (20) including an edge face (23) provided with a profiled engagement ridge (24) extending along a second curvilinear longitudinal profile (29) and adapted to engage in said bezel (13);

wherein the second longitudinal profile (29) is such that over any segment of said second longitudinal profile (29) having a length of twenty millimeters along the curvilinear abscissa or contained within an angular sector of thirty degrees about a geometrically central or optical axis (A1) of the ophthalmic lens (20), the departure of the second longitudinal profile (29) from the first longitudinal profile (12) varies between a maximum departure value and a minimum departure value, with the difference between them being greater than or equal to 0.05 millimeters.

10. Visual equipment according to claim 8, wherein the difference between the maximum value and the minimum value is less than 0.3 millimeters.

11. A method of preparing an ophthalmic lens (20) for mounting in a surround (11) of an eyeglass frame (10), the method comprising:

an acquisition step of acquiring a first longitudinal profile (12) of said surround (11); and an edging step of edging the ophthalmic lens (20) with a generally profiled engagement ridge (24) being formed on its edge face (23), the ridge having a desired section and extending along a second longitudinal profile (25) derived from the first longitudinal profile (12);

wherein the method includes a determination step of determining at least fifteen free singular points (Pl) along the second longitudinal profile (25) in alternation with as many bearing points (Pa); and in that during the edging step, the engagement ridge (24) is formed to present free singular sections (Sl) at said free singular points (Pl) and bearing sections (Sa) at said bearing points (Pa), the free singular sections (Sl) being smaller in width or in height than said bearing sections (Sa).

12. A method of preparing an ophthalmic lens (20) for mounting in a surround (11) of an eyeglass frame (10), the method comprising:

an acquisition step of acquiring a first longitudinal profile (12) of said surround (11); and an edging step of edging the ophthalmic lens (20) with a generally profiled engagement ridge (24) being formed on its edge face (23), the ridge having a desired section and extending along a second longitudinal profile (25) derived from the first longitudinal profile (12);

wherein the method includes a determination step of determining at least fifteen free singular points (Pl) along the second longitudinal profile (25) in alternation with as many bearing points (Pa); and in that during the edging step, the engagement ridge (24) is formed so that the departure of the second longitudinal profile (29) from the first longitudinal profile (12) varies so as to take a value at each free singular point (Pl) that is greater by at least 0.05 millimeters than the value of said departure at the two bearing points (Pa) that are directly consecutive therewith.

13. The method according to claim 11, wherein the bearing points (Pa) and the three singular points (Pl) are determined independently of the shapes of the first and second longitudinal profiles (12, 25; 29).

14. The method according to claim 13, wherein the bearing points (Pa) and the free singular points (Pl) are determined independently of the horizon line (A3) of the frame of reference of the eyeglass frame (10) and of the horizon line of the optical frame of reference of the ophthalmic lens (20).

15. The method according to claim 11, wherein, after the determination step, a search is made in a database registry in which each record is associated with a reference type of eyeglass frame (10) and contains the shape of the second longitudinal profile (25; 29), for a record that corresponds to the frame in question, and the positions of the free singular points (Pl) and of the bearing points (Pa) on the second longitudinal profile (25; 29) are written to said record.

16. The method according to claim 11, wherein, during the determination step, said free singular points (Pl) are distributed randomly over the second longitudinal profile (25; 29).

17. The method according to claim 11, wherein, in order to determine said bearing points (Pa) and said free singular points (Pl), a database registry is read in which each record is associated with a reference type of eyeglass frame (10) and contains both the shape of a second longitudinal profile (25; 29) corresponding to said reference type of eyeglass frame, and also the positions along said second longitudinal profile (25; 29) of said bearing points (Pa) and said free singular points (Pl).

18. The method according to claim 11, implemented by means of a system comprising firstly a client terminal installed beside a client and including computer means for recording and transmitting order data concerning the ophthalmic lens (20), said order data including data relating to the frame, and secondly a manufacturer terminal installed beside a manufacturer and including computer means for receiving and recording the order data transmitted by the client terminal, and a shaper device for edging said ophthalmic lens, the device being designed to implement said edging step, said acquisition step comprising:

a determination step of the client determining the first longitudinal profile (12) of the surround of the eyeglass frame (10); and an ordering step of the client terminal sending order data and of the manufacturer terminal receiving said data, said data incorporating said first longitudinal profile (12).

19. The method according to claim 11, implemented by means of a system comprising firstly a client terminal installed beside a client and including computer means for recording and transmitting order data concerning the ophthalmic lens (20), said order data including data relating to the frame, and secondly a manufacturer terminal installed beside a manufacturer and including computer means for receiving and recording the order data transmitted by the client terminal, a shaper device for edging said ophthalmic lens, the device being designed to implement said edging step, said acquisition step comprising:

a determination step of the client determining a reference of the eyeglass frame (10); and an ordering step of the client terminal sending order data and of the manufacturer terminal receiving said data, said data incorporating said reference; and a searching step of the manufacturer terminal searching, in a database registry in which each record is associated with a type of eyeglass frame (10) and contains a reference for said frame and the first longitudinal profile (12) of the surround of said frame, for a record associated with the frame reference in question.

20. Visual equipment according to claim 9, wherein the difference between the maximum value and the minimum value is less than 0.3 millimeters.

* * * * *

UNITED STATES PATENT AND TRADEMARK OFFICE

CERTIFICATE OF CORRECTION

PATENT NO. : 8,672,479 B2
APPLICATION NO. : 12/864569
DATED : March 18, 2014
INVENTOR(S) : Ahmed Haddadi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 905 days.

Signed and Sealed this
Twenty-ninth Day of September, 2015

Michelle K. Lee

Michelle K. Lee
*Director of the United States Patent and Trademark Office*